US011231191B2

(12) United States Patent
Fieldhouse

(10) Patent No.: US 11,231,191 B2
(45) Date of Patent: Jan. 25, 2022

(54) AUTOMATIC FOUNDATION VENT PLUG WITH MANUAL OVERRIDE

(71) Applicant: Air Vent, Inc., Dallas, TX (US)

(72) Inventor: Richard Fieldhouse, Portland, OR (US)

(73) Assignee: AIR VENT, INC.

( * ) Notice: Subject to any disclaimer, the term of this patent is extended or adjusted under 35 U.S.C. 154(b) by 417 days.

(21) Appl. No.: 16/428,729

(22) Filed: May 31, 2019

(65) Prior Publication Data

US 2019/0376709 A1 Dec. 12, 2019

Related U.S. Application Data

(60) Provisional application No. 62/681,898, filed on Jun. 7, 2018.

(51) Int. Cl.
*F24F 11/00* (2018.01)
*F24F 13/14* (2006.01)

(52) U.S. Cl.
CPC ..... *F24F 11/0001* (2013.01); *F24F 13/1413* (2013.01); *F24F 13/1426* (2013.01); *F24F 2013/144* (2013.01)

(58) Field of Classification Search
CPC ..... F24F 11/0001; F24F 13/1413; F24F 13/1426; F24F 2013/144
See application file for complete search history.

(56) References Cited

U.S. PATENT DOCUMENTS

| | | | | |
|---|---|---|---|---|
| 4,290,554 | A | 9/1981 | Hensley | |
| 4,493,456 | A | 1/1985 | Sarazen | |
| 4,669,371 | A | 6/1987 | Sarazen | |
| 4,699,045 | A | 10/1987 | Hensley | |
| 4,715,532 | A | 12/1987 | Sarazen | |
| 4,754,696 | A | 7/1988 | Sarazen | |
| 4,962,882 | A | 10/1990 | Sarazen | |
| 5,194,700 | A * | 3/1993 | Lin | H04R 1/023 181/155 |
| 5,957,373 | A | 9/1999 | Sarazen | |
| 6,302,784 | B1 * | 10/2001 | Berger | F24F 13/02 454/289 |
| 7,780,509 | B1 | 8/2010 | Hoaks | |

* cited by examiner

*Primary Examiner* — Avinash A Savani
*Assistant Examiner* — Phillip Decker
(74) *Attorney, Agent, or Firm* — Jennifer Meredith, Esq.; Lippes Mathias Wexler Friedman LLP

(57) ABSTRACT

A housing with a top wall, a bottom wall, left end wall, right end wall, and a front cover each having a plurality of openings; a louver connector in a first opening of a first louver and a second opening of a second louver and connected to a third louver that extends between the left end wall and an interior wall (the louvers each being pivotally mounted); a connector attached to the third louver that receives a tab end of a bi-coil that is thermally activated to move the third louver to an open or closed position and the louver connector moves the first louver and the second louver to a corresponding position; and a manual override lever that moves the second louver to an open or closed position and the louver connector moves the first louver and the third louver to a corresponding position.

19 Claims, 19 Drawing Sheets

AUTOMATIC FOUNDATION VENT PLUG WITH MANUAL OVERRIDE

This application claims priority to provisional patent application 62/681,898 filed Jun. 7, 2018 and entitled, "Automatic Foundation Vent Plug Auto Plug" which is incorporated herein by reference.

The present invention relates generally to an "auto" closing vent "plug" to replace a manually installed EPS foam plug or damper closure of a foundation vent on a building to address seasonal changes in temperature. One advantage of the present invention is that it may be automatically controlled by temperature or manually overridden to an open or closed position. The positioning of the louvers, louver connector, bi-coil and manual override lever provide a foundation vent that may be automatically controlled by temperature, or overridden by a manual lever, according to the users desire.

Another advantage of the present invention is the use of an internal flange which may be attached to an existing foundation opening and receives tabs in the housing for easy installation and removal.

These and other features, aspects and advantages of the present invention will become better understood with reference to the following description and claims.

SUMMARY OF THE INVENTION

The present invention relates to a ventilation apparatus for use in a foundation.

According to one embodiment of the present invention, an automatic foundation vent plug with manual override is provided having a housing, the housing having a top wall and a bottom wall extending substantially parallel to one another and a left end wall and a right end wall extending substantially parallel to one another and a front cover extending between the top wall, the bottom wall, the left end wall and the right end wall and a plurality of openings in the front cover, the top wall, bottom wall, the left end wall and the right end wall; a louver connector; a first louver that extends between the left end wall and the right end wall with a left end protrusion pivotally mounted in the left end wall and a right end protrusion pivotally mounted in the right end wall and the first louver having a first opening that accepts a portion of the louver connector; a second louver that extends between the left end wall and the right end wall with a left end protrusion pivotally mounted in the left end wall and a right end protrusion pivotally mounted in the right end wall and the second louver having a second opening that accepts a portion of the louver connector; a third louver which is shorter in length than then first louver and the second louver and extends between the left end wall and an interior wall and has a left end protrusion pivotally mounted in the left end wall; a connector attached to the third louver above the interior wall, wherein the connector receives a tab end of a bi-coil that is pivotally mounted in the right end wall, wherein the louver connector is attached to the third louver at a left side of the third louver, wherein the bi-coil is thermally activated to move the third louver to an open or closed position and the louver connector moves the first louver and the second louver to a corresponding position; and a manual override lever with a push end, a middle portion and a louver end, wherein the louver end is communication with the second louver to move the second louver to an open or closed position and the louver connector moves the first louver and the third louver to a corresponding position.

These and other features, aspects and advantages of the present invention will become better understood with reference to the following description and claims.

DETAILED DESCRIPTION OF THE INVENTION

Figure 1:
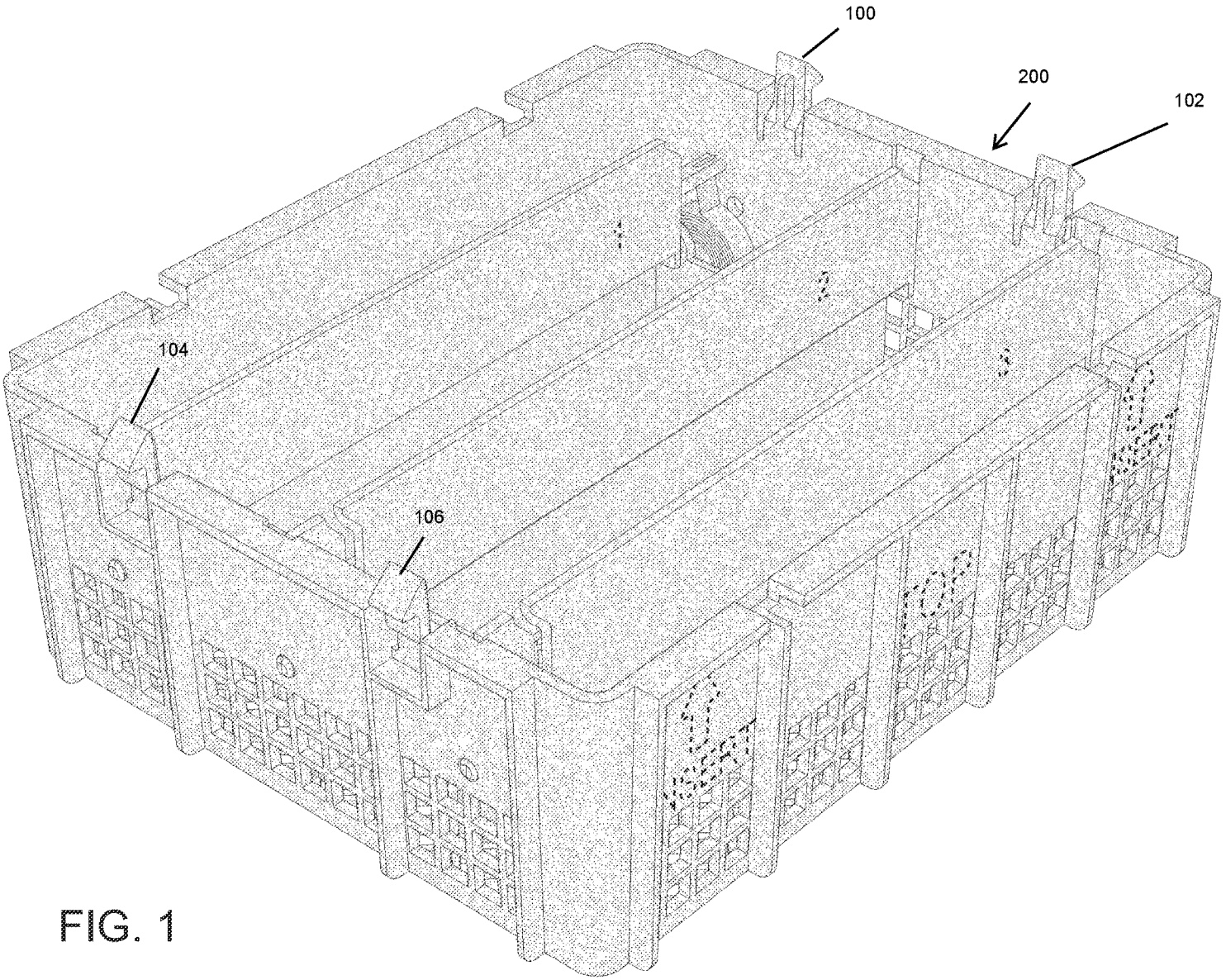
FIG. 1 depicts the present invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

With reference to FIGS. 1-19, an automatic foundation vent plug with manual override is provided having a housing (200), the housing (200) having a top wall (202) and a bottom wall (204) extending substantially parallel to one another and a left end wall (206) and a right end wall (208) extending substantially parallel to one another and a front cover (300) extending between the top wall (202), the bottom wall (204), the left end wall (206) and the right end wall (208) and a plurality of openings in the front cover (300), the top wall (202), bottom wall (204), the left end wall (206) and the right end wall (208). The plurality of openings may be substantially rectangular shaped. The automatic foundation vent plug having a louver connector (216), first louver (210), a second louver (212), a third louver (214), a connector (220), a bi-coil (224) and a manual override lever (1600). The first louver (210) extends between the left end wall (206) and the right end wall (208) with a left end protrusion (800) pivotally mounted in the left end wall (206) a right end protrusion (808) pivotally mounted in the right end wall (208) and the first louver (210) having a first opening (232) that accepts a portion of the louver connector (216). The first louver may have a substantially straight upper leg portion (1704) with a curved L shaped end (1706), a middle portion (1708) with the protrusion and a curved lower leg portion (1712) having a upper portion (1711) and a curved lower portion (1713). The substantially straight upper leg portion (1704) is spaced apart from and runs substantially parallel to the upper portion (1711) of the curved lower leg portion (1712). The first opening (232) in the first louver may be in the substantially straight upper leg portion (1704) with a curved L shaped end (1706).

The second louver (212) extends between the left end wall (206) and the right end wall (208) with a left end protrusion (802) pivotally mounted in the left end wall (206) and a right end protrusion (806) pivotally mounted in the right end wall (208) and the second louver (212) having a second opening (234) that accepts a portion of the louver connector (216). The second louver has a substantially straight upper leg portion (1714) with a curved L shaped end (1716), a middle portion (1718) and a substantially straight lower leg portion (1720) with a return leg (1722). The substantially straight upper leg portion (1714) is spaced apart from and runs substantially parallel to the substantially straight lower leg portion (1720) and the return leg (1722) is substantially perpendicular to the substantially straight lower leg portion (1720). The second opening (234) in the second louver may be in the substantially straight upper leg portion (1714) with a curved L shaped end (1716).

The third louver may have a substantially straight upper leg portion (1730) having a connector (220) along a mid-section of the substantially straight upper leg portion (1730) and a curved L shaped end (1732), a middle portion (1734) and a substantially straight lower leg portion (1736) with a return leg (1738).

Figure 2:
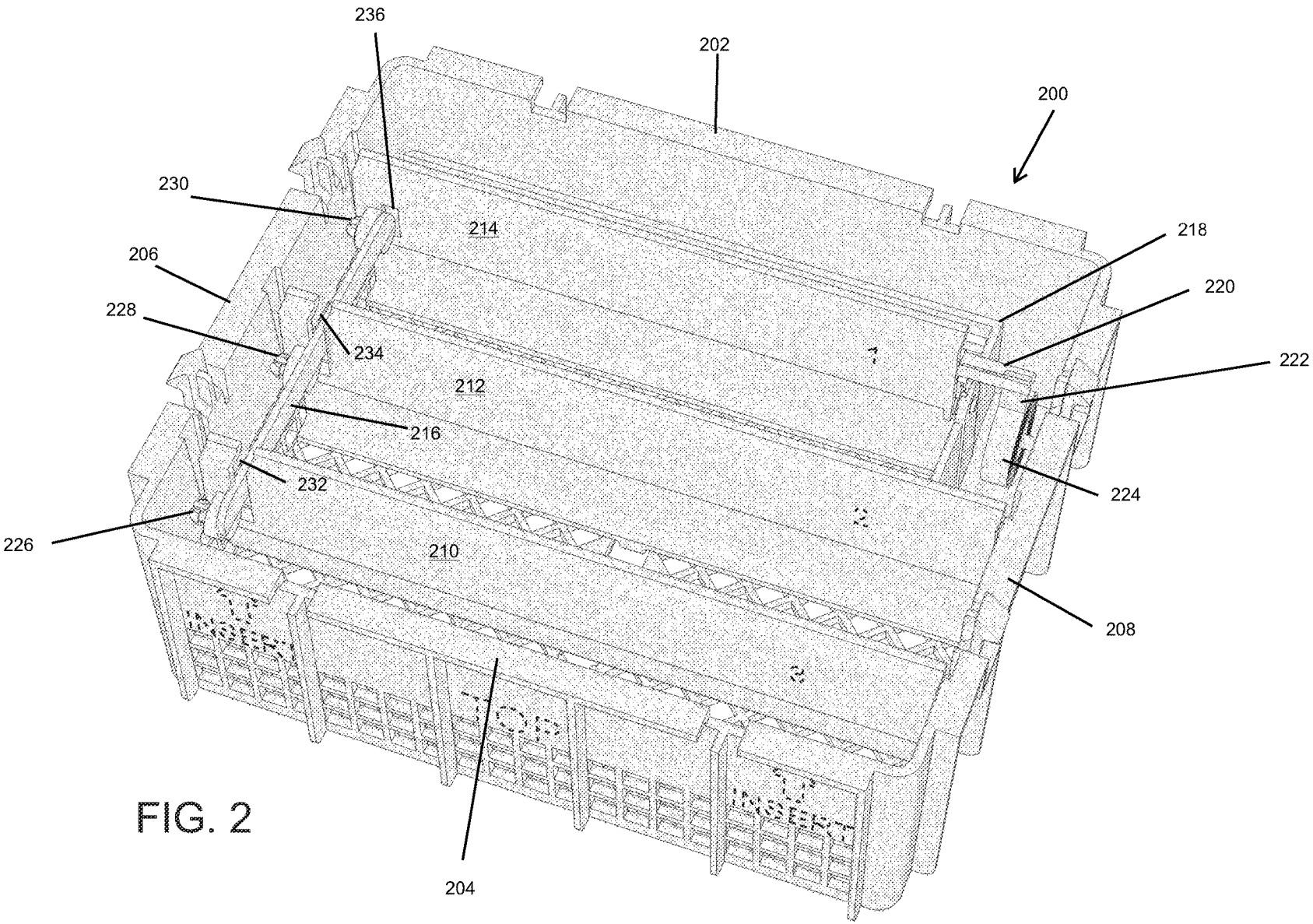
FIG. 2 depicts the present invention.
Figure 3:
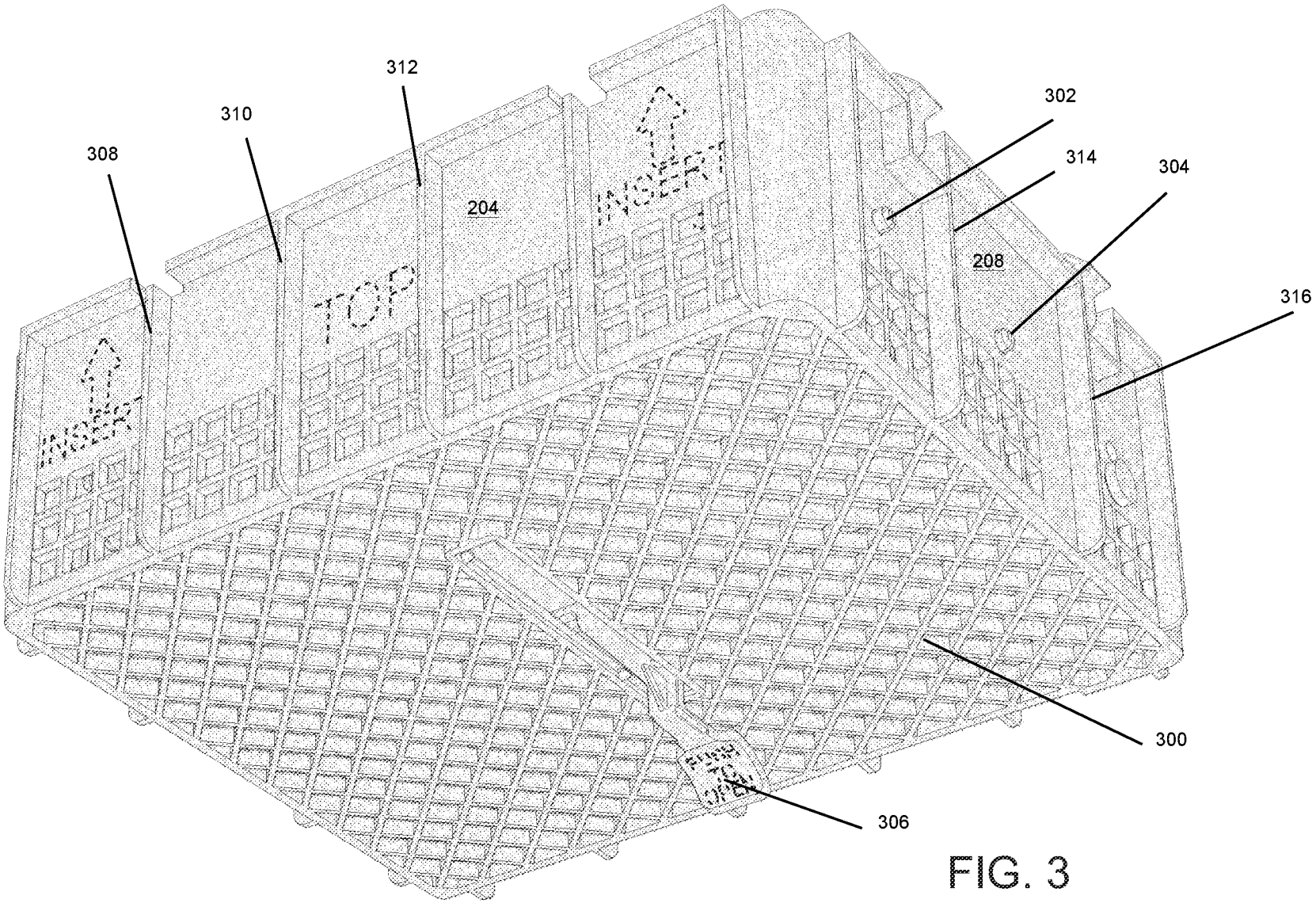
FIG. 3 depicts the present invention.
Figure 4:
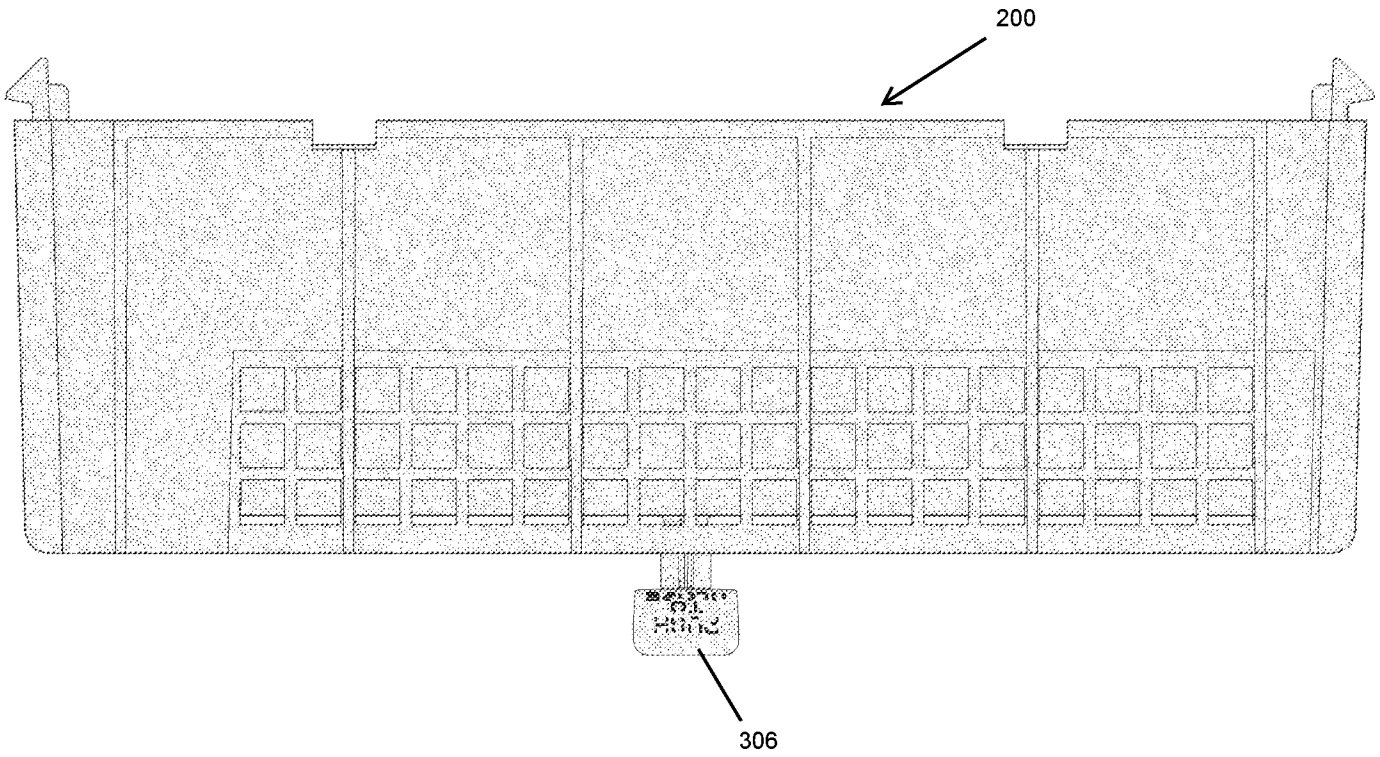
FIG. 4 depicts the present invention.
Figure 5:
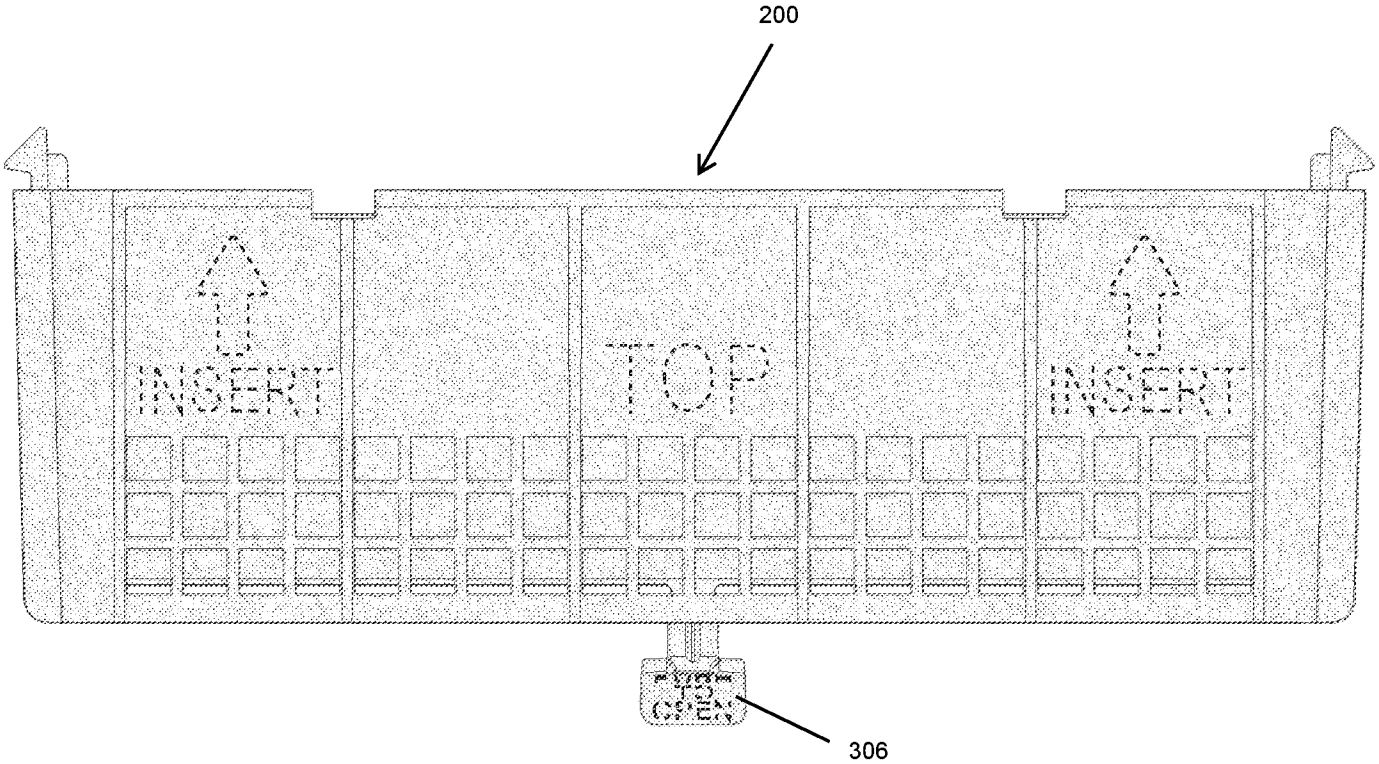
FIG. 5 depicts the present invention.
Figure 6:
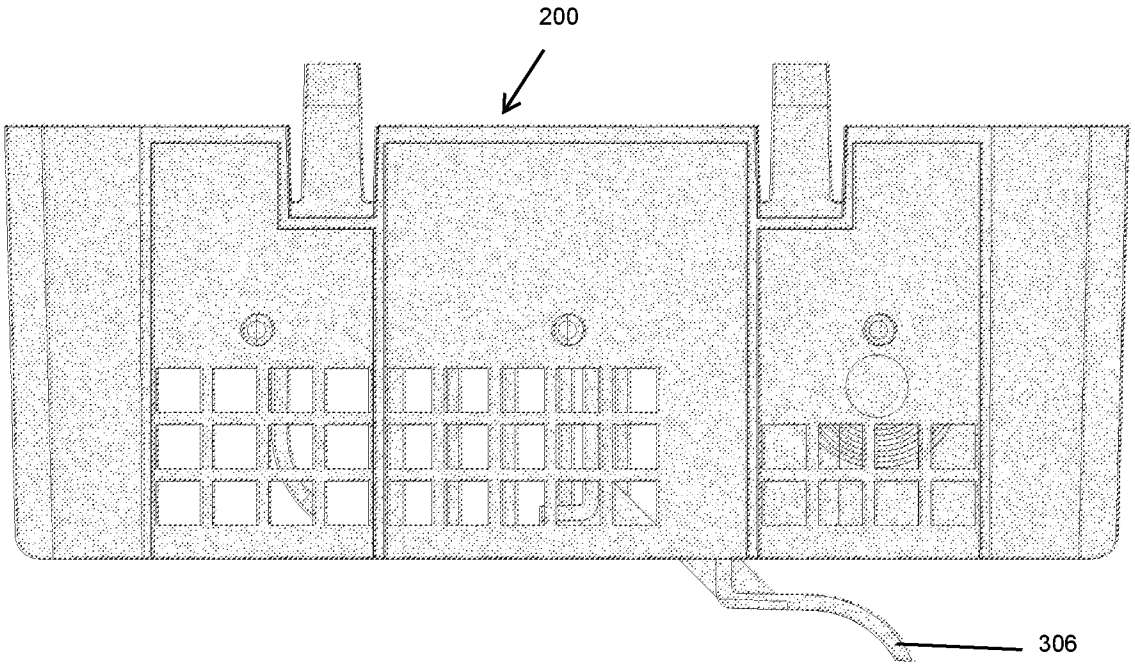
FIG. 6 depicts the present invention.
Figure 7:
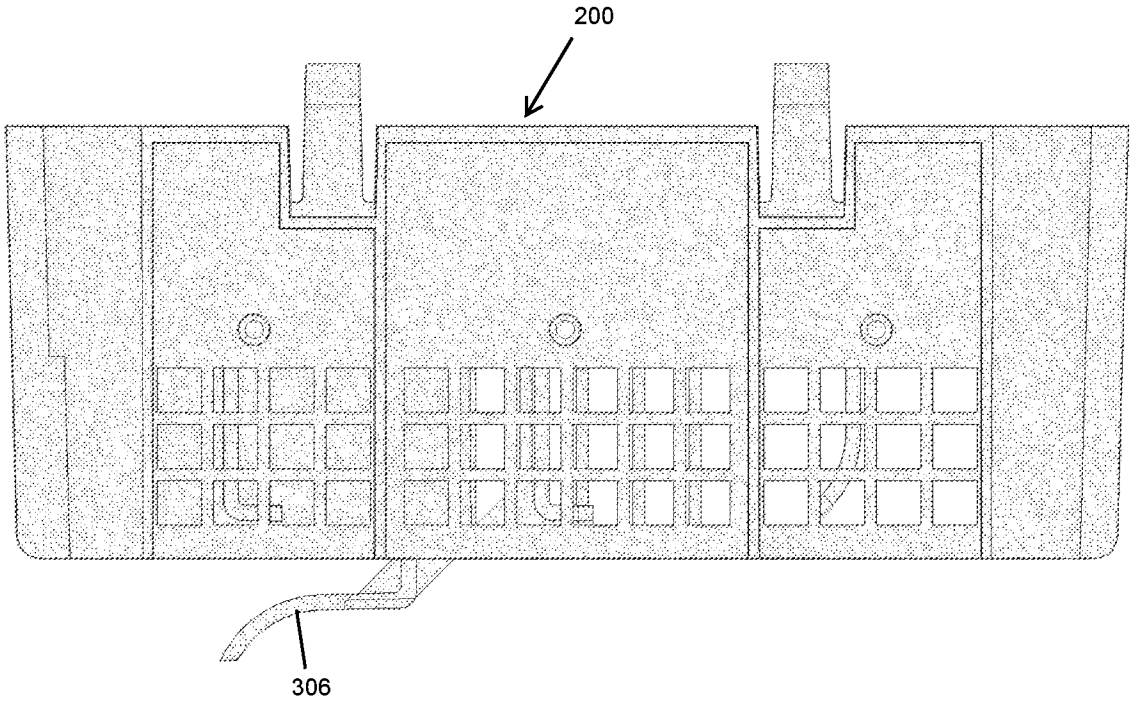
FIG. 7 depicts the present invention.
Figure 8:
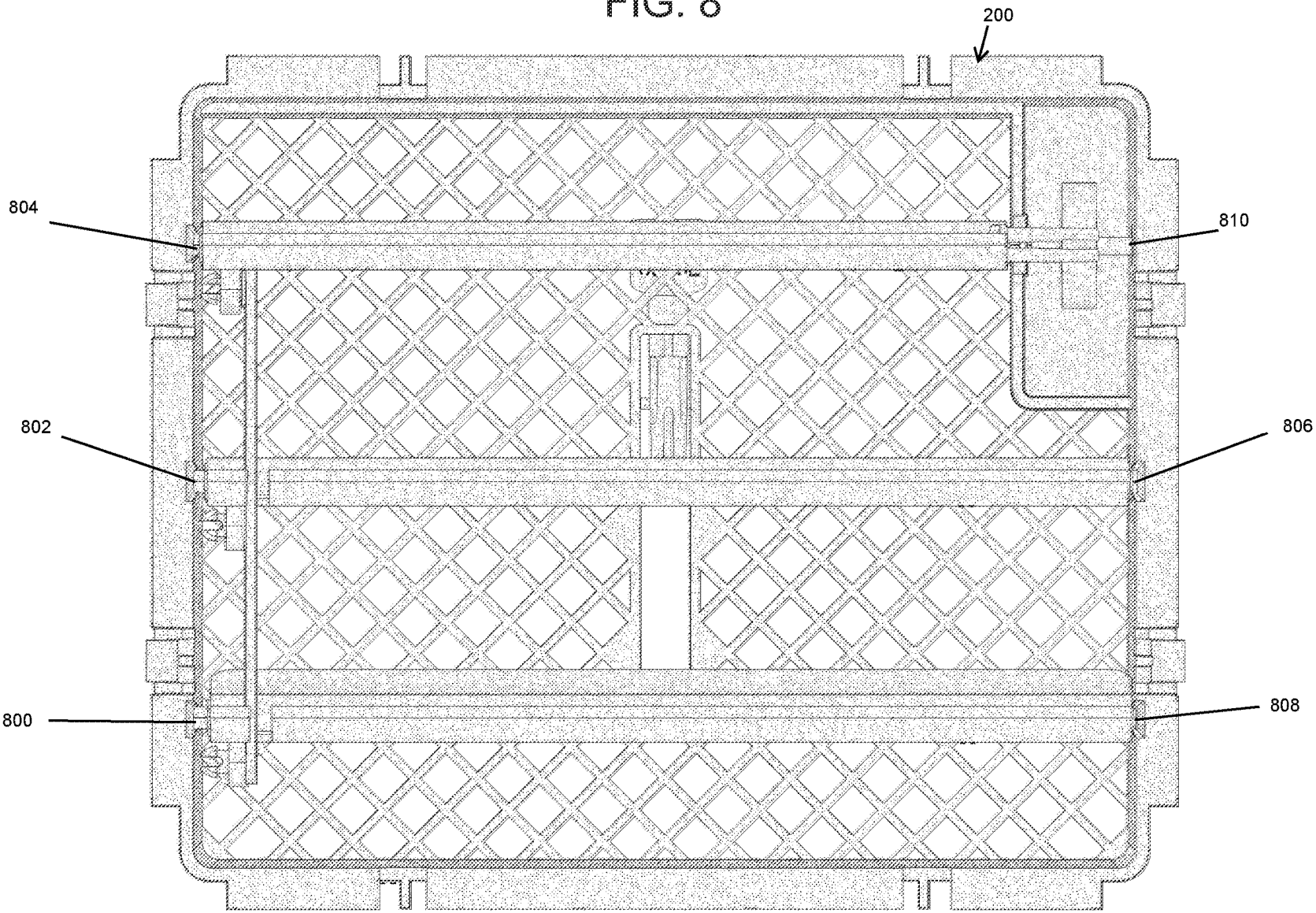
FIG. 8 depicts the present invention.
Figure 9:
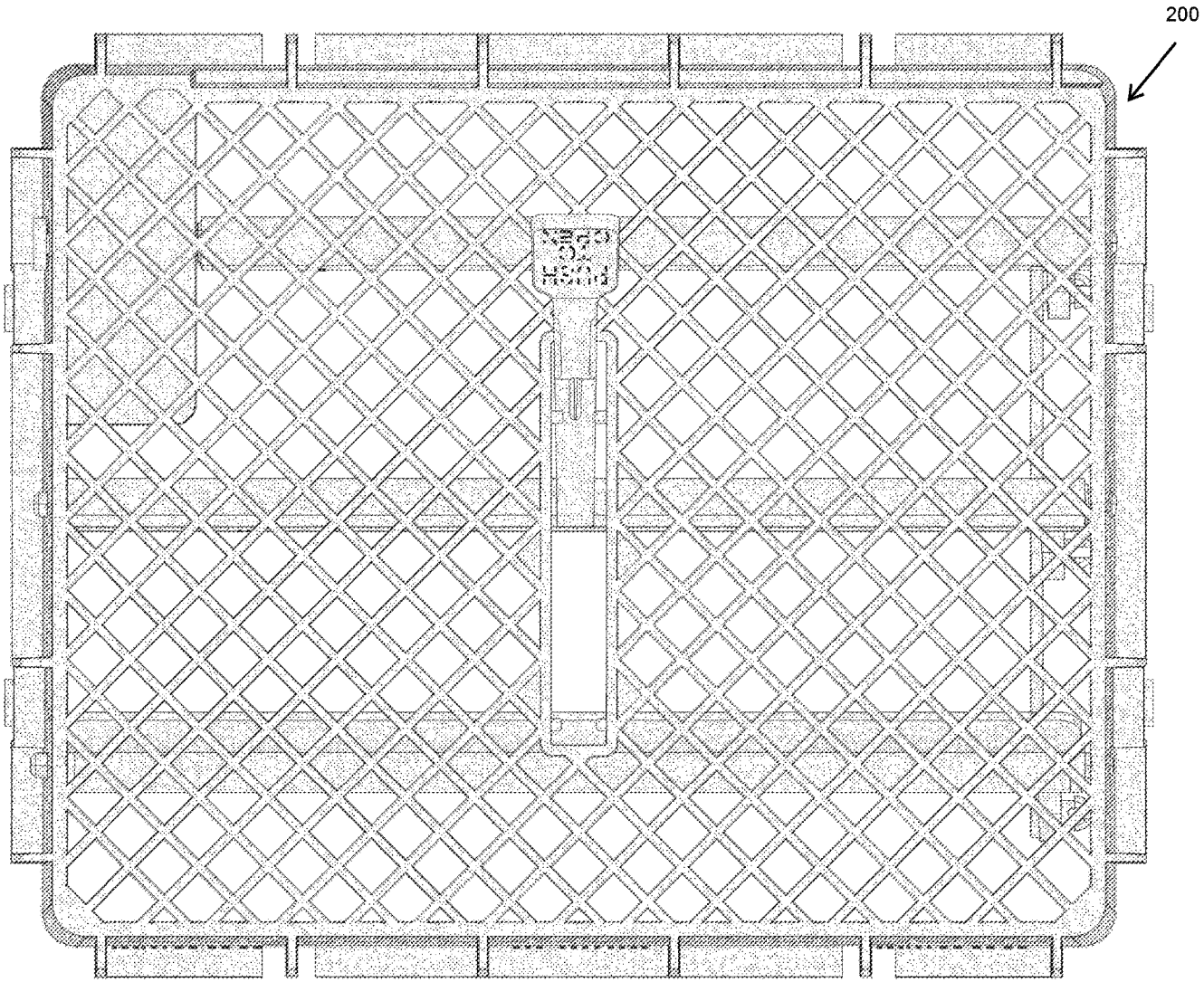
FIG. 9 depicts the present invention.
Figure 10:
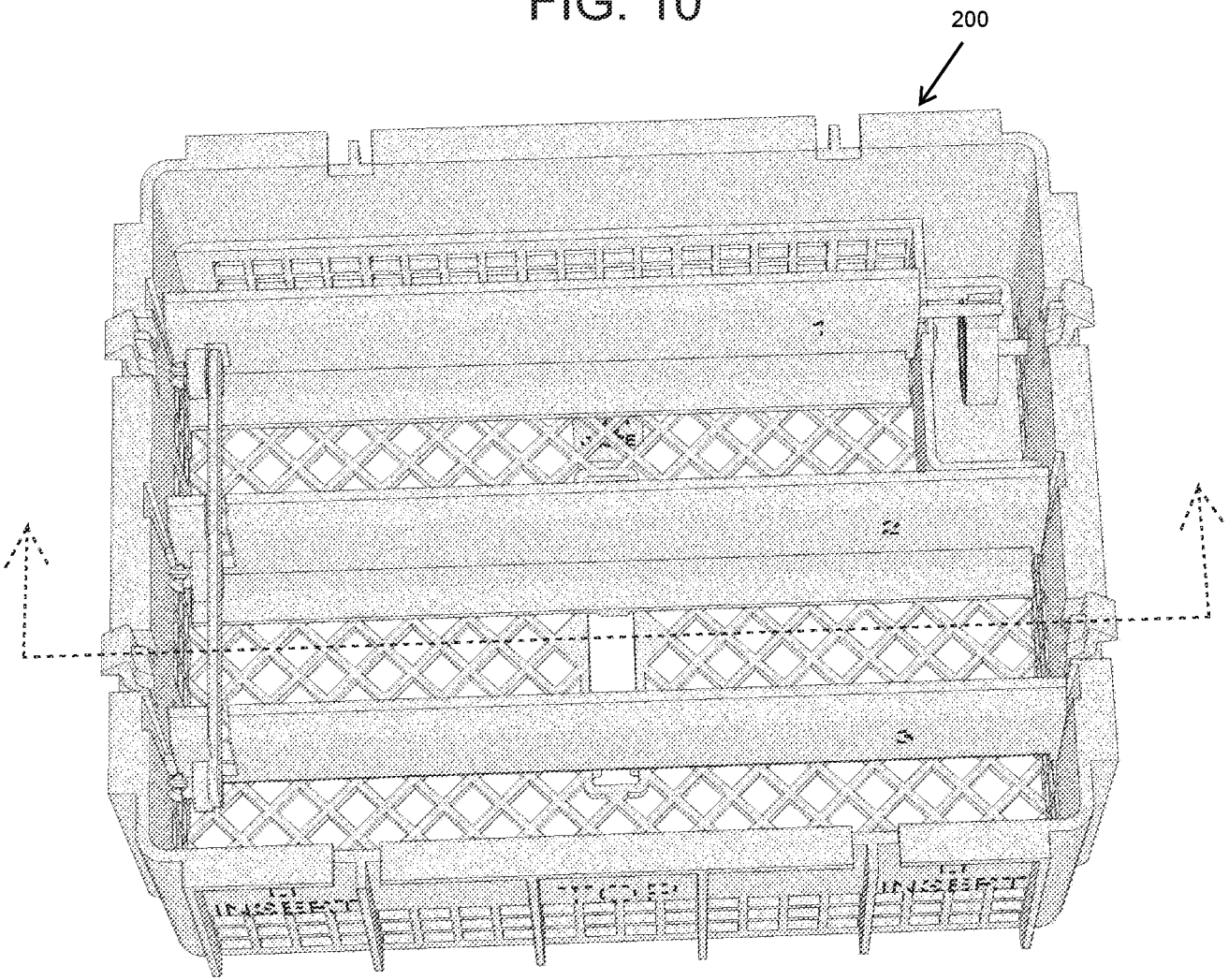
FIG. 10 depicts the present invention.
Figure 11:
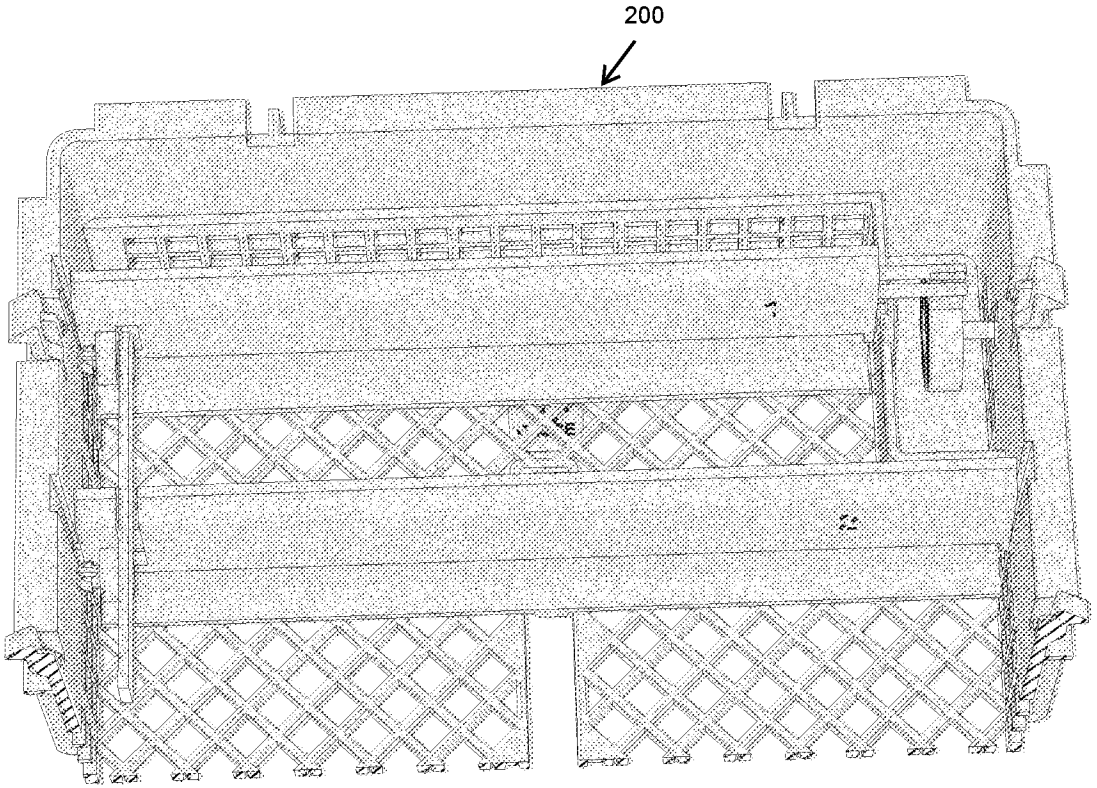
FIG. 11 depicts the present invention.
Figure 12:
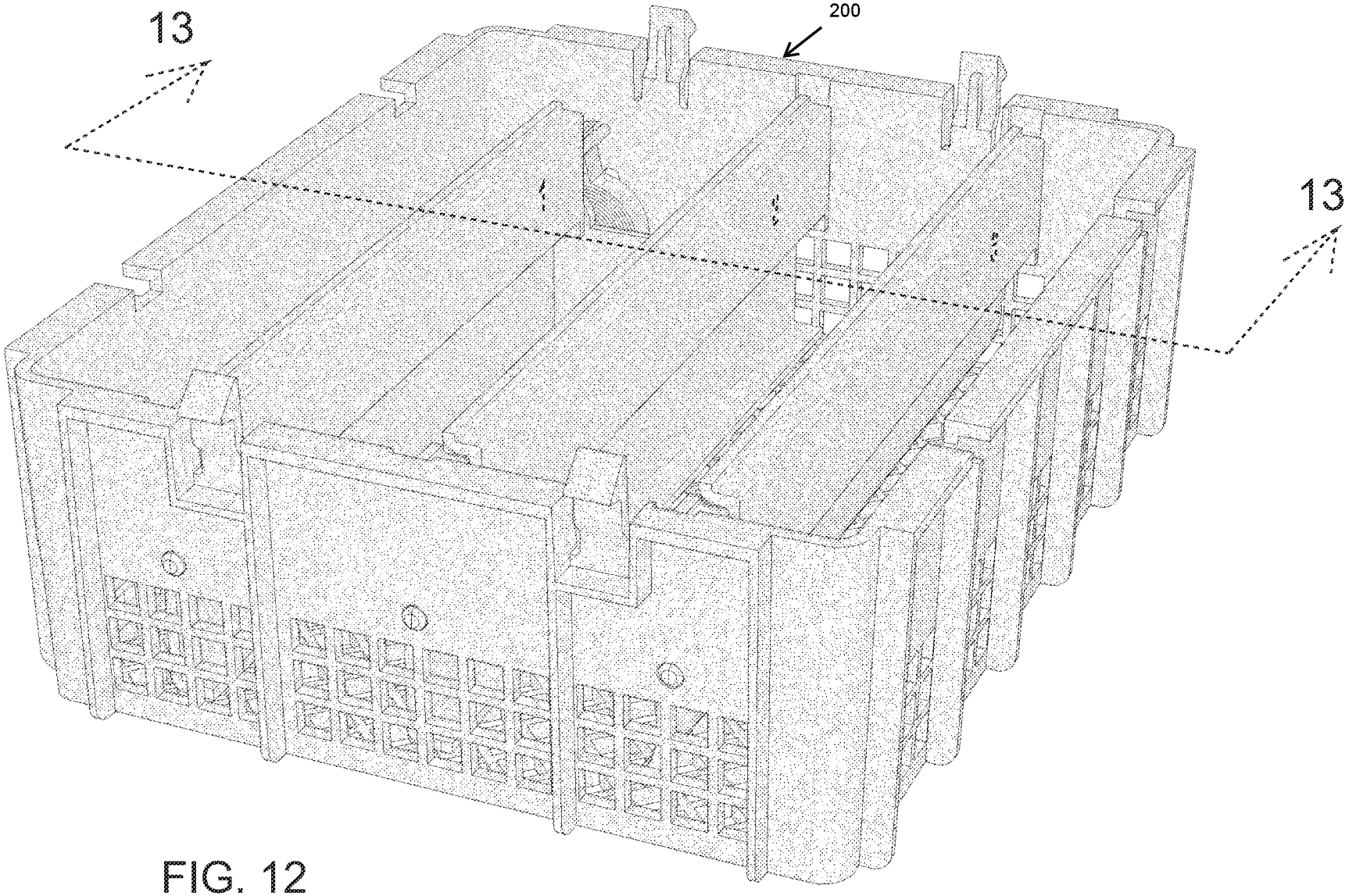
FIG. 12 depicts the present invention.
Figure 13:
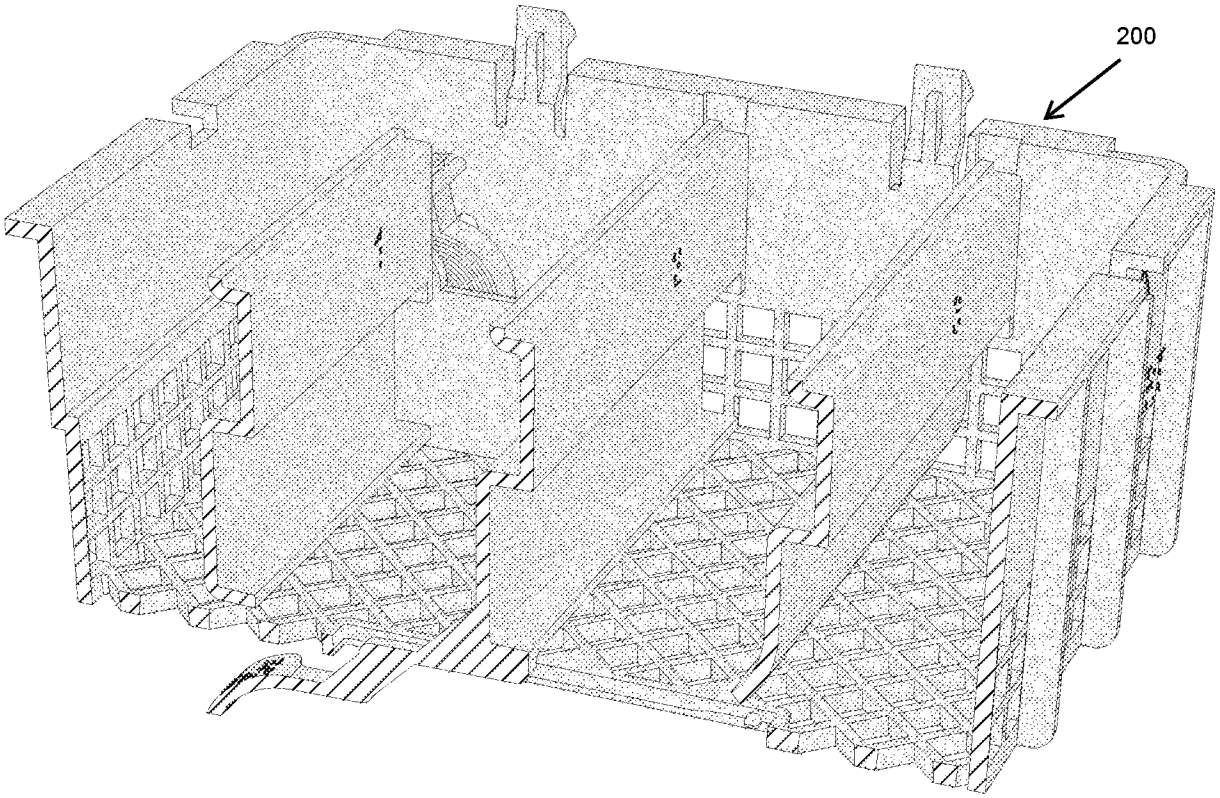
FIG. 13 depicts the present invention.
Figure 14:
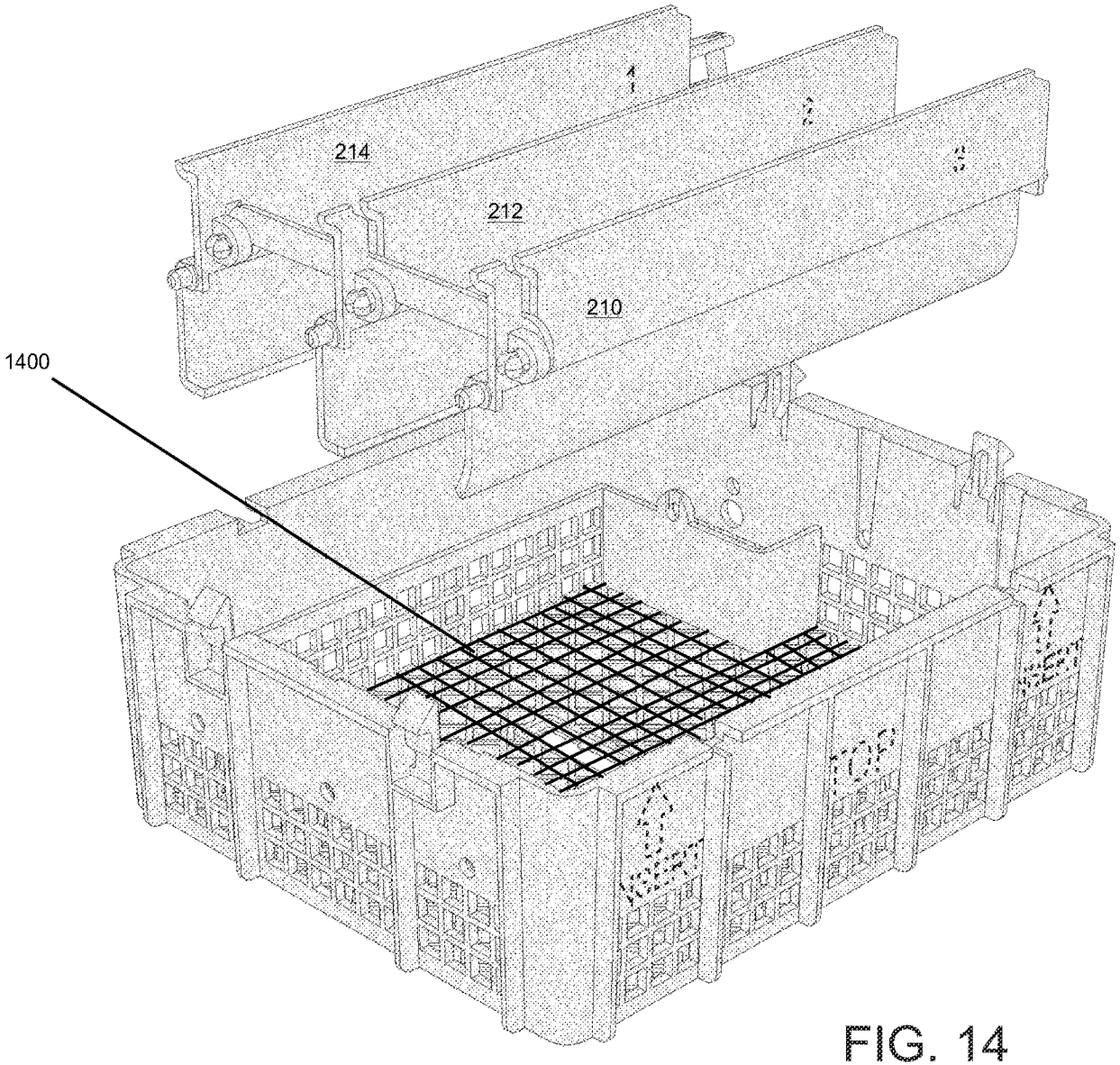
FIG. 14 depicts the present invention.
Figure 15:
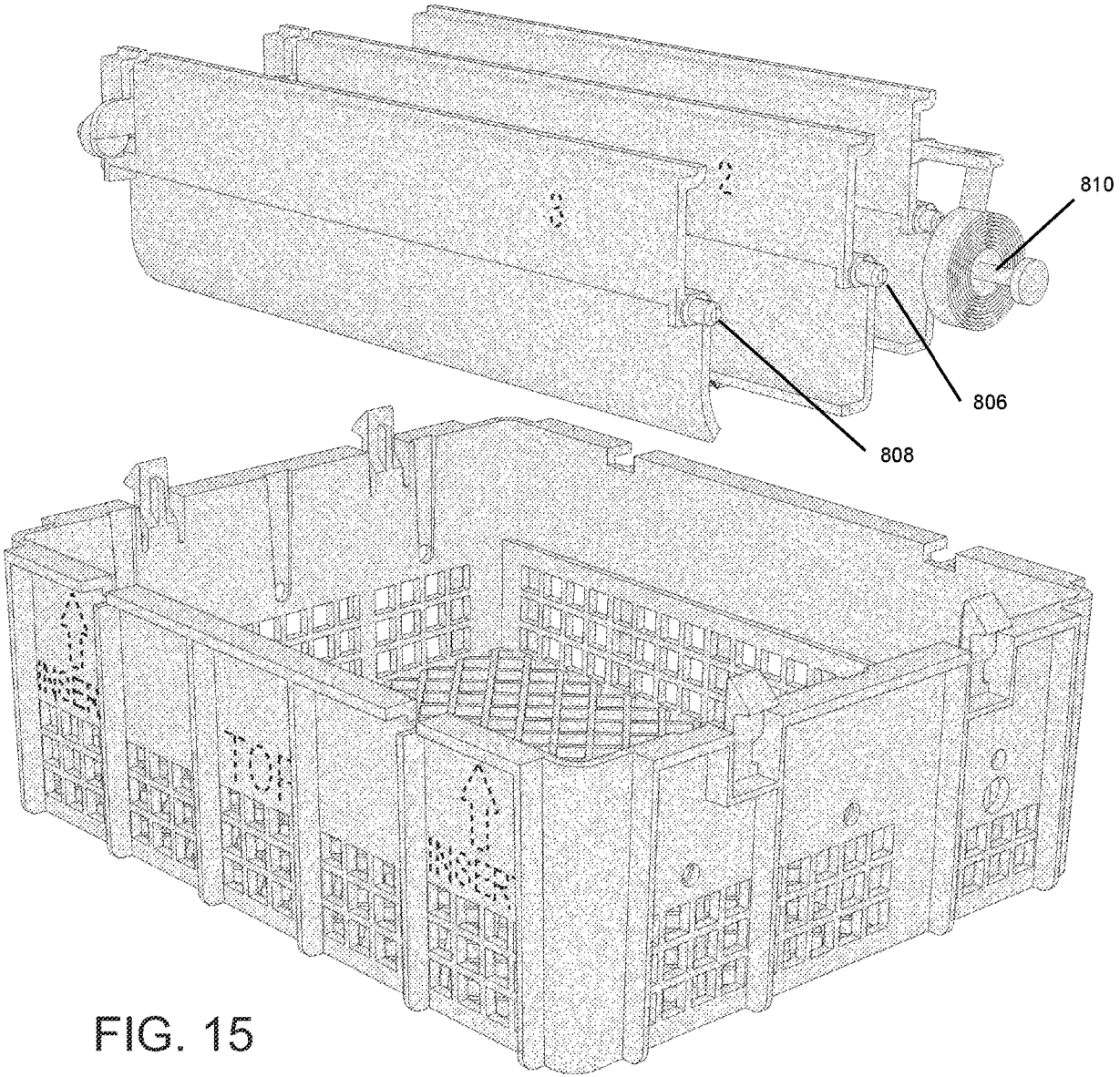
FIG. 15 depicts the present invention.
Figure 16:
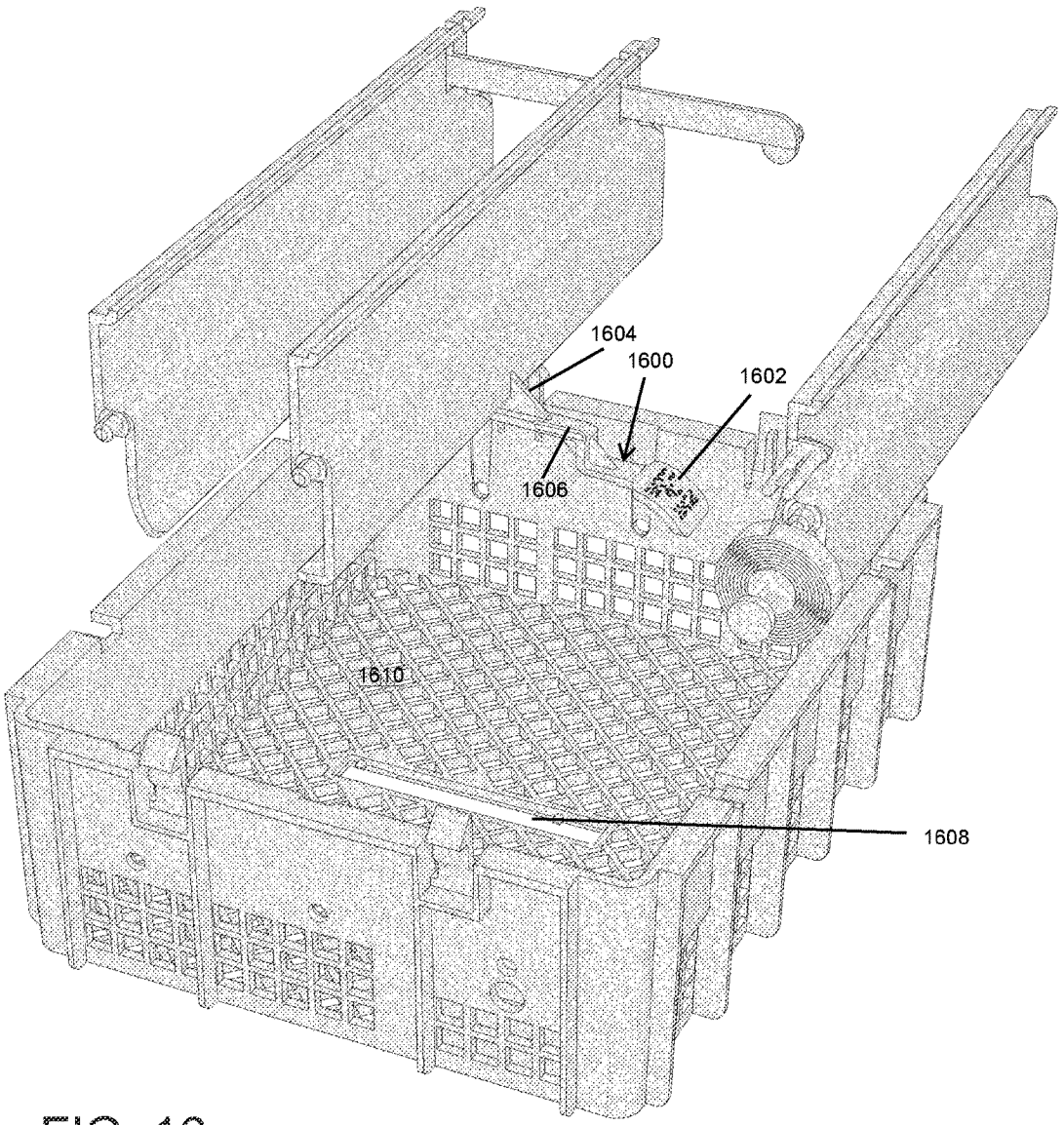
FIG. 16 depicts the present invention.
Figure 17:
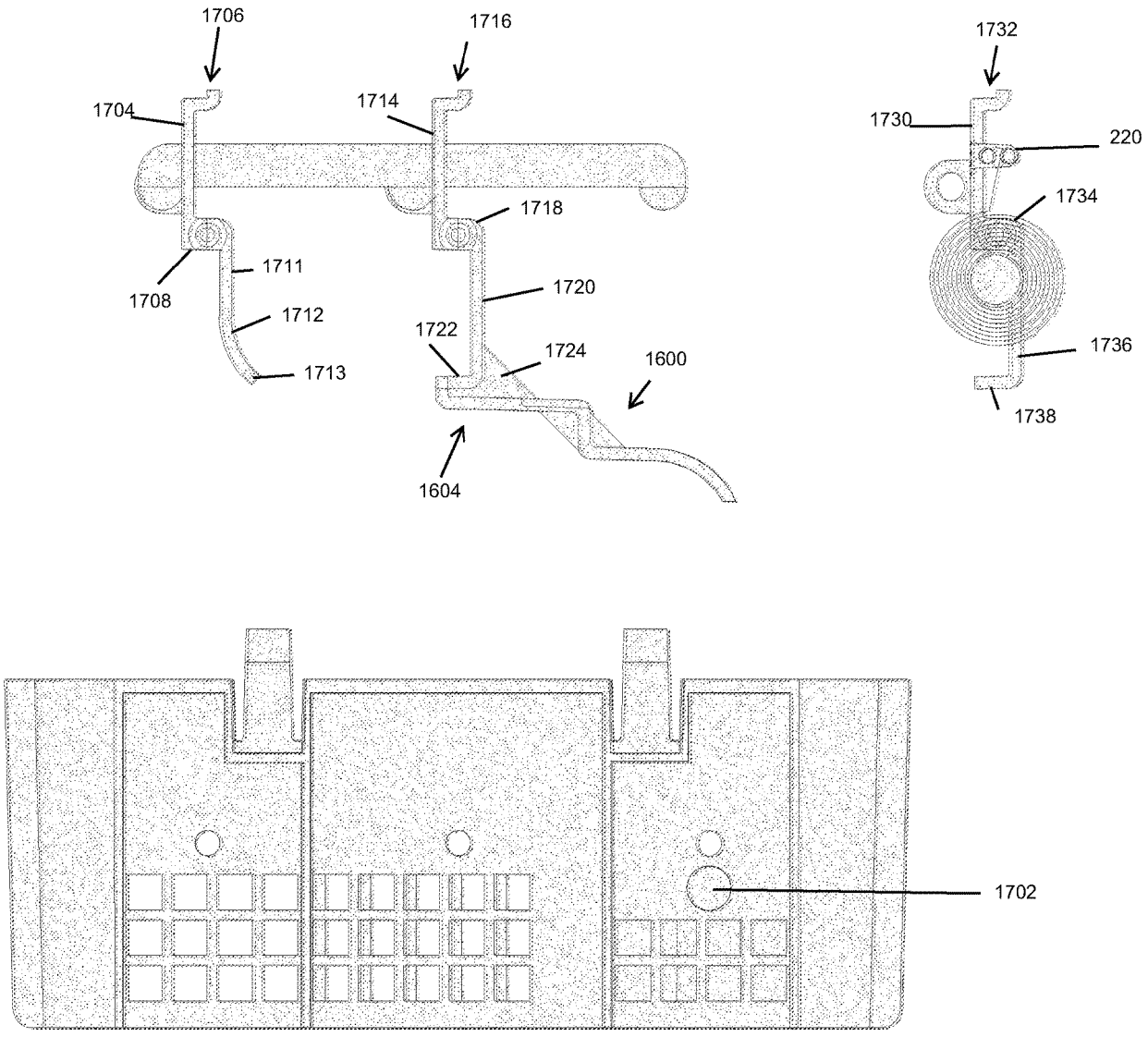
FIG. 17 depicts the present invention.
Figure 18:
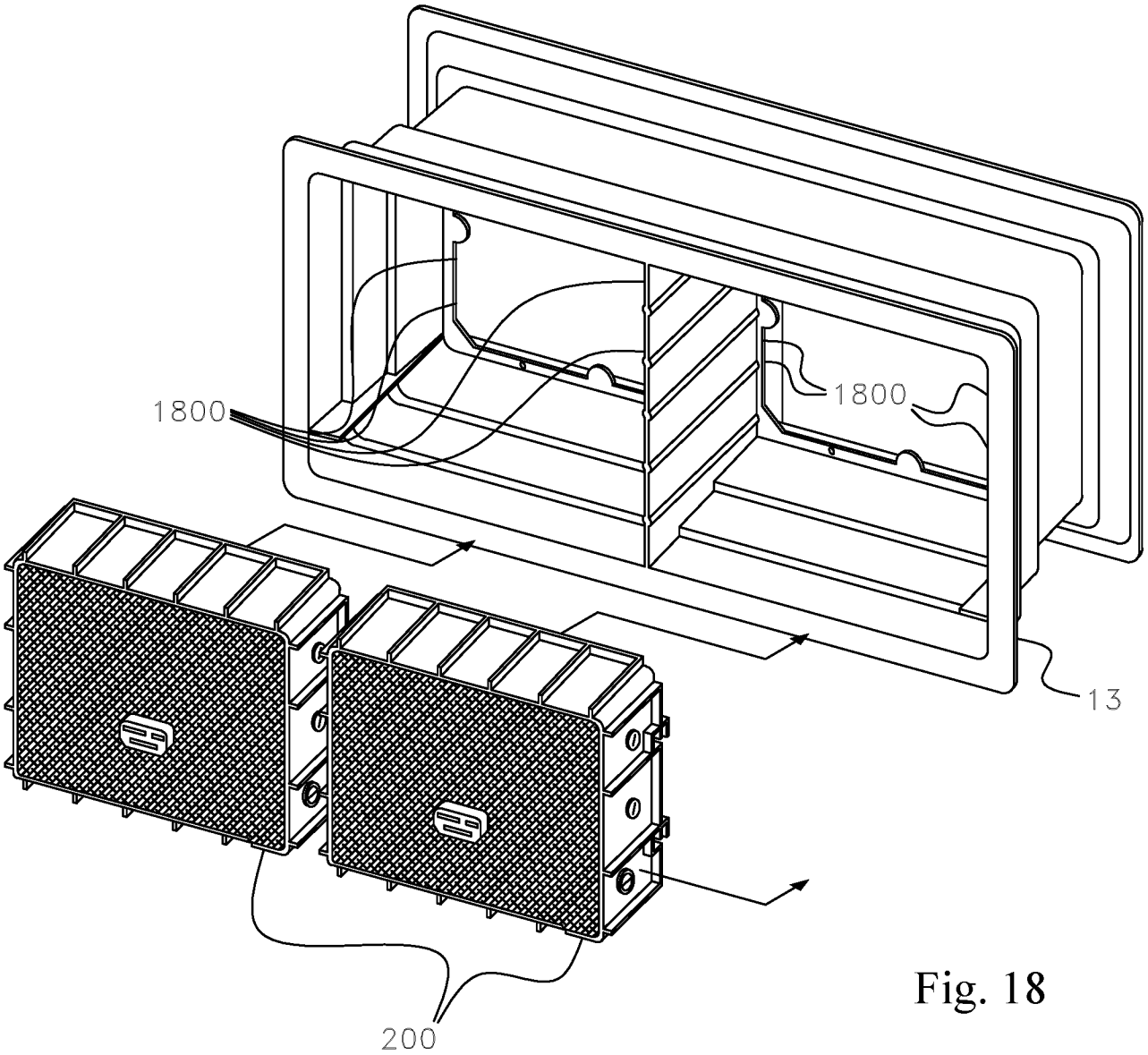
FIG. 18 depicts the present invention.
Figure 19:
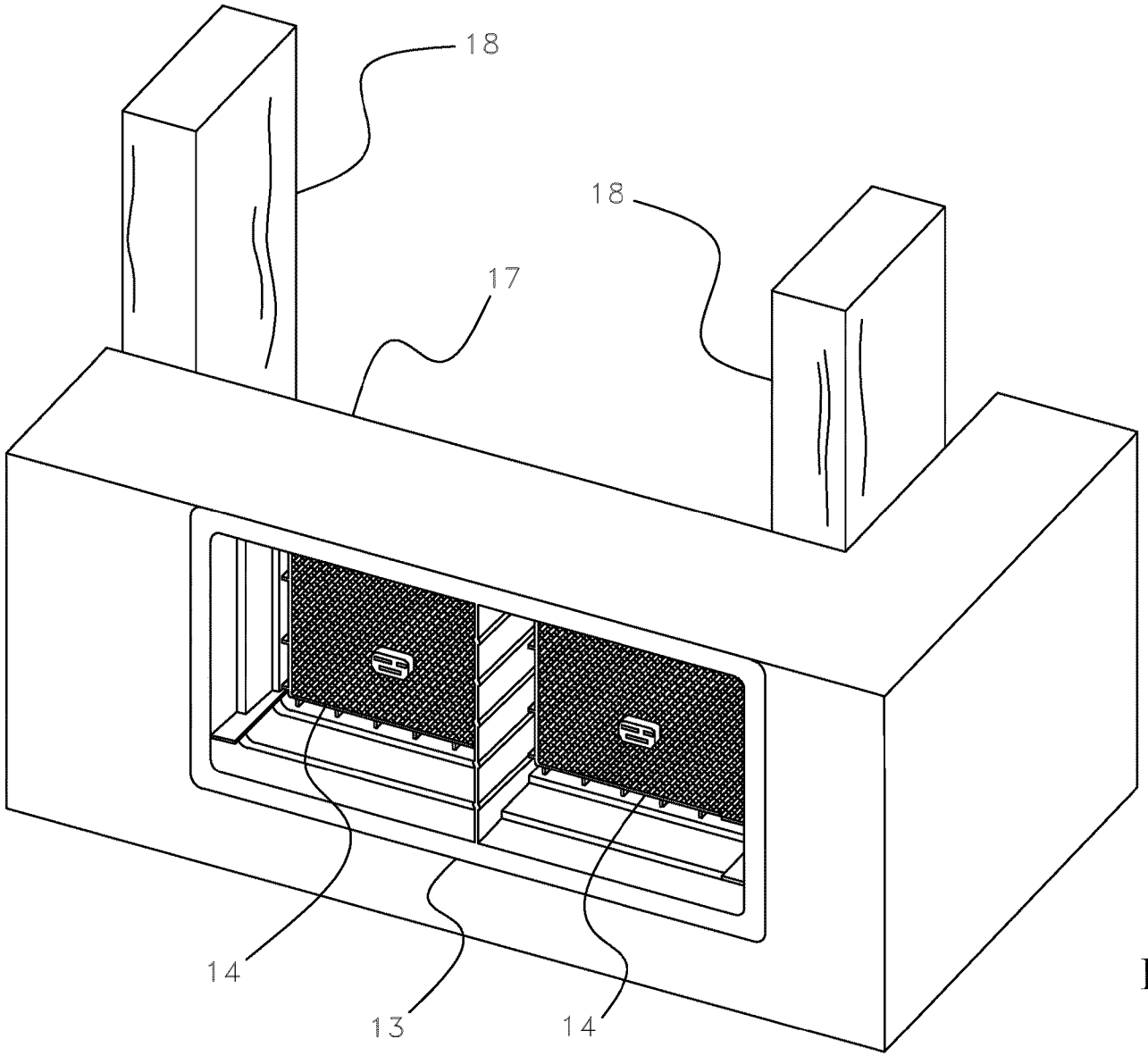
FIG. 19 depicts the present invention.

The louver connector (216) may have three protrusions (226, 228 and 230). The three protrusions may serve to retain the louver connector in the first and second louver. The first opening (232) and the second opening (234) may be substantially rectangular shaped. The third louver (214) is shorter in length than the first louver (210) and the second louver (212) and extends between the left end wall (206) and an interior wall (218) and has a left end protrusion (804) pivotally mounted in the left end wall (206). The protrusions may be split circle shaped protrusions (as shown in FIGS. 2 and 16 showing a circular protrusion that is split in the middle with a small space). The split circle shaped protrusions allow the protrusion to be inserted into holes (in the left end wall (206) and the right end wall (208)) and be retained and still capable of rotating. The connector (220) is attached to the third louver (214) above the interior wall (218) and receives a tab end (222) of a bi-coil (224) that is pivotally mounted in the right end wall (208). The louver connector (216) is attached to the third louver (214) at a left side (236) of the third louver (214). It may be attached (or glued) to the third louver (214) or inserted in an opening in the third louver (214). The bi-coil (224) is thermally activated which moves the third louver to an open or closed position and the louver connector moves the first louver (210) and the second louver (212) to a corresponding position. The bi-coil (224) may have a center spool (810) that is pivotally mounted in an circular opening (1702) in the right end wall (208).

There is a manual override lever (1600) with a push end (1602), a middle portion (1606) and a louver end (1604). The louver end (1604) is in communication with the second louver (212) to move the second louver (212) to an open or closed position and the louver connector (216) moves the first louver (210) and the third louver (214) to a corresponding position. The middle portion (1606) of the manual override lever (1600) is contained in a slot opening (1608) of the front cover (1610). The louver end (1604) of the manual override lever (1600) is communication with the second louver (212) and may have a substantially triangular shaped support portion (1724). The rectangular shape support provides additional support and leverage. The manual override lever (1600) in an open or closed position renders the bi-coil (224) inoperative. In this way, the manual override lever (1600) overrides the bi-coil (224).

The automatic foundation vent plug may also have a plurality of stability protrusions (308, 310, 312, 314 and 316) on an outer portion of the top wall (202), the bottom wall (204), the left end wall (206) and the right end wall (208). The stability protrusions add stability to the housing and still allow for the housing to ventilate by way of the openings.

The vent plug may also have at least two tabs (104, 106) in the left end wall (206) and at least two tabs (100, 102) in the right end wall (208); and an internal flange (1800) to receive the at least two tabs in the left end wall (206) and at least two tabs in the right end wall (208). The internal flange (1800) may be installed in an existing foundation vent (13) of a building. Foundation vents may also be made with internal flanges incorporated therein.

There may also be a screen (1400) parallel to the front cover (300) and extending between the top wall (202), the bottom wall (204), the left end wall (206) and the right end wall (208).

It should be understood that the foregoing relates to preferred embodiments of the invention and that modifications may be made without departing from the spirit and scope of the invention as set forth in the following claims.

I claim:

1. An automatic foundation vent plug with manual override, the automatic foundation vent plug with manual override comprising:

a housing, the housing having a top wall and a bottom wall extending substantially parallel to one another and a left end wall and a right end wall extending substantially parallel to one another and a front cover extending between the top wall, the bottom wall, the left end wall and the right end wall and a plurality of openings in the front cover, the top wall, bottom wall, the left end wall and the right end wall;

a louver connector;

at least two tabs in the left end wall and at least two tabs in the right end wall; and an internal flange to receive the at least two tabs in the left end wall and at least two tabs in the right end wall;

a first louver extending between the left end wall and the right end wall with a left end protrusion pivotally mounted in the left end wall a right end protrusion pivotally mounted in the right end wall and the first louver having a first opening that accepts a portion of the louver connector;

a second louver extending between the left end wall and the right end wall with a left end protrusion pivotally mounted in the left end wall and a right end protrusion pivotally mounted in the right end wall and the second louver having a second opening that accepts a portion of the louver connector;

a third louver shorter in length than then first louver and the second louver and extending between the left end wall and an interior wall and having a left end protrusion pivotally mounted in the left end wall;

a connector attached to the third louver above the interior wall, wherein the connector receives a tab end of a bi-coil that is pivotally mounted in the right end wall, wherein the louver connector is attached to the third louver at a left side of the third louver, wherein the bi-coil is thermally activated to move the third louver to an open or closed position and the louver connector moves the first louver and the second louver to a corresponding position; and a manual override lever with a push end, a middle portion and a louver end, wherein the louver end is communication with the second louver to move the second louver to an open or closed position and the louver connector moves the first louver and the third louver to a corresponding position.

2. An automatic foundation vent plug with manual override as in claim 1, wherein the internal flange is installed in an existing foundation vent of a building.

3. An automatic foundation vent plug with manual override as in claim 1, wherein the protrusions are split circle shaped protrusions.

4. An automatic foundation vent plug with manual override as in claim 1, wherein the plurality of openings in the front cover, the top wall, bottom wall, the left end wall and the right end wall are substantially rectangular shaped.

5. An automatic foundation vent plug with manual override as in claim 1, further comprising a plurality of stability protrusions on an outer portion of the top wall, the bottom wall, the left end wall and the right end wall.

6. An automatic foundation vent plug with manual override as in claim 1, wherein the middle portion of the manual override lever is contained in a slot opening of the front cover.

7. An automatic foundation vent plug with manual override as in claim 1, further comprising a screen parallel to the front cover and extending between the top wall, the bottom wall, the left end wall and the right end wall.

8. An automatic foundation vent plug with manual override as in claim 1, wherein the bi-coil is further comprised of a center spool that is pivotally mounted in a circular opening in the right end wall.

9. An automatic foundation vent plug with manual override as in claim 1, wherein the manual override lever in an open or closed position renders the bi-coil inoperative.

10. An automatic foundation vent plug with manual override as in claim 1, the louver connector having three protrusions.

11. An automatic foundation vent plug with manual override, the automatic foundation vent plug with manual override comprising:

a housing, the housing having a top wall and a bottom wall extending substantially parallel to one another and a left end wall and a right end wall extending substantially parallel to one another and a front cover extending between the top wall, the bottom wall, the left end wall and the right end wall and a plurality of openings in the front cover, the top wall, bottom wall, the left end wall and the right end wall;

a louver connector;

a first louver extending between the left end wall and the right end wall with a left end protrusion pivotally mounted in the left end wall a right end protrusion pivotally mounted in the right end wall and the first louver having a first opening that accepts a portion of the louver connector;

a second louver extending between the left end wall and the right end wall with a left end protrusion pivotally mounted in the left end wall and a right end protrusion pivotally mounted in the right end wall and the second louver having a second opening that accepts a portion of the louver connector;

a third louver shorter in length than then first louver and the second louver and extending between the left end wall and an interior wall and having a left end protrusion pivotally mounted in the left end wall;

a connector attached to the third louver above the interior wall, wherein the connector receives a tab end of a bi-coil that is pivotally mounted in the right end wall, wherein the louver connector is attached to the third louver at a left side of the third louver, wherein the bi-coil is thermally activated to move the third louver to an open or closed position and the louver connector moves the first louver and the second louver to a corresponding position; and a manual override lever with a push end, a middle portion and a louver end, wherein the louver end is communication with the second louver to move the second louver to an open or closed position and the louver connector moves the first louver and the third louver to a corresponding position, wherein the first louver has a substantially straight upper leg portion with a curved L shaped end, a middle portion with the protrusion and a curved lower leg portion having a upper portion and a curved lower portion.

12. An automatic foundation vent plug as in claim 11, wherein the substantially straight upper leg portion is spaced apart from and runs substantially parallel to the upper portion of the curved lower leg portion.

13. An automatic foundation vent plug with manual override as in claim 11, wherein the first opening in the first louver is in the substantially straight upper leg portion with a curved L shaped end.

14. An automatic foundation vent plug with manual override as in claim 13, wherein the first opening and the second opening are substantially rectangular shaped.

15. An automatic foundation vent plug with manual override, the automatic foundation vent plug with manual override comprising:

a housing, the housing having a top wall and a bottom wall extending substantially parallel to one another and a left end wall and a right end wall extending substantially parallel to one another and a front cover extending between the top wall, the bottom wall, the left end wall and the right end wall and a plurality of openings in the front cover, the top wall, bottom wall, the left end wall and the right end wall;

a louver connector;

a first louver extending between the left end wall and the right end wall with a left end protrusion pivotally mounted in the left end wall a right end protrusion pivotally mounted in the right end wall and the first louver having a first opening that accepts a portion of the louver connector;

a second louver extending between the left end wall and the right end wall with a left end protrusion pivotally mounted in the left end wall and a right end protrusion pivotally mounted in the right end wall and the second louver having a second opening that accepts a portion of the louver connector;

a third louver shorter in length than then first louver and the second louver and extending between the left end wall and an interior wall and having a left end protrusion pivotally mounted in the left end wall;

a connector attached to the third louver above the interior wall, wherein the connector receives a tab end of a bi-coil that is pivotally mounted in the right end wall, wherein the louver connector is attached to the third louver at a left side of the third louver, wherein the bi-coil is thermally activated to move the third louver to an open or closed position and the louver connector moves the first louver and the second louver to a corresponding position; and a manual override lever with a push end, a middle portion and a louver end, wherein the louver end is communication with the second louver to move the second louver to an open or closed position and the louver connector moves the first louver and the third louver to a corresponding position, wherein the second louver has a substantially straight upper leg portion with a curved L shaped end, a middle portion and a substantially straight lower leg portion with a return leg.

16. An automatic foundation vent plug as in claim 15, wherein the substantially straight upper leg portion is spaced apart from and runs substantially parallel to the substantially straight lower leg portion and the return leg is substantially perpendicular to the substantially straight lower leg portion.

17. An automatic foundation vent plug as in claim 16, wherein the louver end of the manual override lever is communication with the second louver with a substantially triangular shaped support portion of the manual override lever.

18. An automatic foundation vent plug with manual override as in claim 15, wherein the second opening in the second louver is in the substantially straight upper leg portion with a curved L shaped end.

19. An automatic foundation vent plug with manual override, the automatic foundation vent plug with manual override comprising:

a housing, the housing having a top wall and a bottom wall extending substantially parallel to one another and a left end wall and a right end wall extending substantially parallel to one another and a front cover extending between the top wall, the bottom wall, the left end wall and the right end wall and a plurality of openings in the front cover, the top wall, bottom wall, the left end wall and the right end wall;

a louver connector;

a first louver extending between the left end wall and the right end wall with a left end protrusion pivotally mounted in the left end wall a right end protrusion pivotally mounted in the right end wall and the first louver having a first opening that accepts a portion of the louver connector;

a second louver extending between the left end wall and the right end wall with a left end protrusion pivotally mounted in the left end wall and a right end protrusion pivotally mounted in the right end wall and the second louver having a second opening that accepts a portion of the louver connector;

a third louver shorter in length than then first louver and the second louver and extending between the left end wall and an interior wall and having a left end protrusion pivotally mounted in the left end wall;

a connector attached to the third louver above the interior wall, wherein the connector receives a tab end of a bi-coil that is pivotally mounted in the right end wall, wherein the louver connector is attached to the third louver at a left side of the third louver, wherein the bi-coil is thermally activated to move the third louver to an open or closed position and the louver connector moves the first louver and the second louver to a corresponding position; and a manual override lever with a push end, a middle portion and a louver end, wherein the louver end is communication with the second louver to move the second louver to an open or closed position and the louver connector moves the first louver and the third louver to a corresponding position, wherein the third louver has a substantially straight upper leg portion having a connector along a mid-section of the substantially straight upper leg portion and a curved L shaped end, a middle portion and a substantially straight lower leg portion with a return leg.

* * * * *